US006763560B2

(12) United States Patent
McGee et al.

(10) Patent No.: US 6,763,560 B2
(45) Date of Patent: Jul. 20, 2004

(54) SPREADER FOR SEPARATING TURBINE BUCKETS ON WHEEL

(75) Inventors: Dwight McGee, Schaghticoke, NY (US); Mike Tessier, Schenectady, NY (US); Gary Senecal, Niskayuna, NY (US); Kiernan Francis Ryan, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 54 days.

(21) Appl. No.: 10/310,849

(22) Filed: Dec. 6, 2002

(65) Prior Publication Data

US 2004/0107554 A1 Jun. 10, 2004

(51) Int. Cl.[7] ..... B21D 53/78

(52) U.S. Cl. ..... 29/23.51; 29/239; 29/242; 29/267; 29/270; 29/889.1; 29/889.21; 81/484; 81/485; 254/123; 254/131; 254/104

(58) Field of Search ..... 29/889.1, 267, 29/889.21, 239, 270, 242; 81/484, 485; 254/113, 120, 123, 131, 133 R, 104; 7/166

(56) References Cited

U.S. PATENT DOCUMENTS 5,406,683 A * 4/1995 Arnold ..... 29/235
5,713,233 A * 2/1998 McCarthy et al. ..... 72/31.02
6,363,612 B1 4/2002 Roberts et al.

FOREIGN PATENT DOCUMENTS

JP 2002-213204 * 7/2002

* cited by examiner

*Primary Examiner*—David P. Bryant
*Assistant Examiner*—Eric Compton
(74) *Attorney, Agent, or Firm*—Nixon & Vanderhye P. C.

(57) ABSTRACT

A bucket spreading tool is disclosed for separating covers of adjacent turbine buckets, the tool includes: an arm for extending a head of the tool between adjacent turbine wheels and for positioning the head between the adjacent buckets of a wheel, wherein the head includes an attachment to an end of the arm and a forward portion having a front side surface shaped to engage a first bucket of said adjacent buckets, and a rear side surface shaped to engage a second bucket of said adjacent buckets.

14 Claims, 5 Drawing Sheets

SPREADER FOR SEPARATING TURBINE BUCKETS ON WHEEL

BACKGROUND OF THE INVENTION

This invention relates to the field of steam turbine buckets and, particularly, to machining of buckets mounted in the turbine.

Steam turbines generally have annular rows of turbine buckets that are mounted on a rotor. Each row of turbine buckets is arranged around a disc wheel mounted on the rotor. Typically each turbine bucket has a blade section, and a upper and lower shroud sections. The upper shroud is generally referred to as the "cover" of the bucket. The buckets are arranged annularly around the outer periphery of the wheel. The wheel is mounted on the turbine shaft. Several rows of turbine wheels are arranged on the turbine shaft. Each wheel is separated by some predefined distance, e.g. approximately five inches (15 cm), to allow for turbine vanes that are arranged between the rows turbine buckets.

The covers of the buckets are at the outer perimeter of the turbine wheel and bucket assembly. The covers are adjacent the stationary turbine casing. To prevent steam passing over the buckets from leaking over the casing and into the casing, a seal is formed between the casing and covers of the buckets. As part of this seal, sealing teeth are machined onto the upper surface of the covers after the buckets have been assembled onto the wheel. The sealing teeth on the covers are aligned with similarly configured teeth on spill strips of the turbine casing. The non-contact engagement of the sealing teeth on the covers and the teeth on the spill strips prevent steam from leaking past the buckets and into the casing, thereby improving the efficiency of the turbine unit.

The machining of the bucket covers can create metal burs on the covers, including burs that extend into the gaps between adjacent bucket covers. The standard past practice for machining away burs has involved removal of the buckets from the turbine wheel, which requires disassembly of the turbine. After the burs are ground down on the removed bucket, the buckets and turbine are reassembled. This prior bur removal process is extremely time consuming and expensive.

There are occasions when the turbine buckets are machined and repaired after they have been assembled on a disc, and the disc has been mounted on the shaft of the turbine. For example, veneer-sealing teeth are often machined into the ICVs, after their buckets have been mounted on a wheel and the wheel mount on a shaft. Machining the veneer-sealing teeth into the ICVs after the buckets have been assembled on a wheel ensures that the teeth on each cover line up and are aligned with their opposite teeth on the stationary spill strips mounted on the turbine housing.

Machining veneer-sealing teeth often leaves metal burs on ICVs. Some of these metal burs are on the upper surface of the covers and will extend into the gaps between the covers and the spill strips, and other burs may protrude from the sides of the covers and interfere with the interlocking of a cover with its adjacent covers. Shims have been inserted between bucket covers to reduce burs from rolling into the gap between covers.

However, it is difficult to access the gap between turbine covers to insert and remove shims after the buckets have been mounted on a wheel and the wheel mounted on the turbine shaft. It is especially difficult to access the steep-angle interval cover buckets (ICVs) that have been developed to improve steam turbine efficiency. Nevertheless, ICVs and other types of bucket covers do require additional machining after their buckets have been assembled on the wheel and shims are useful for reducing burs.

If the burs on ICVs are substantial they can affect the response characteristics of the turbine bucket to vibration. In particular, large burs on ICVs have been shown to produce substantial resonance frequency shifts in the axial and torsion vibration modes of a bucket. Burs may shift the resonance vibration frequencies of a bucket by more than 10 percent (10%) from the expected resonance frequency for the bucket. Accordingly, the resonance frequency shifts caused by the burs on the ICVs can render inaccurate the expected resonance frequencies for buckets.

Turbine designers rely on the expected resonance frequencies of a bucket to, for example, select the number of upstream nozzles to be adjacent the row of buckets. If a designer properly understands the resonance frequency of the turbine buckets, then the number of upstream nozzles may be selected to minimize the resident frequencies in the buckets. If burs offset the expected resonance frequency of the bucket, the actual vibration resonance of the bucket with burs may unintentionally coincide with vibrations induced by the upstream nozzles and rotating buckets as steam flows from the nozzles to the buckets. If vibrations induced by the steam have frequencies at or near the resonance frequencies of the bucket, then excessive vibration may be induced in the bucket that will cause the bucket to prematurely fail.

There is a long felt need for better tools to machine burs from buckets and use shims to reduce bur formation, especially from the cover of buckets. Such tools,should make the insertion and removal of shims expeditious and inexpensive.

BRIEF DESCRIPTION OF THE INVENTION

A tool has been developed to spread apart the covers of adjacent buckets mount on a turbine wheel. The tool may be applied when the wheels are assembled on a turbine shaft. By separating the covers, shims can be inserted into and removed from the covers.

In one embodiment the invention is a bucket spreading tool for separating covers of adjacent turbine buckets, wherein the tool includes: an arm for extending a head of the tool between adjacent turbine wheels and for positioning the head between the adjacent buckets of a wheel, and the head has an attachment to an end of the arm and a forward portion having a front side surface shaped to engage a first bucket of said adjacent buckets, and a rear side surface shaped to engage a second bucket of said adjacent buckets.

The spreading tool may further include a front surface of the head that is cupped to abut a convex surface of the first bucket, and a rear surface of the head is rounded to pivot against the second bucket. Further, the spreading tool head may include a slot between its front and rear side surfaces, wherein said slot is alignable with gap between the covers of the adjacent turbine buckets.

The bucket spreading tool of the first embodiment may have a tool head that is separable from the arm, and tool head height that is no greater than three inches which is less than the distance between the adjacent turbine wheels. Further the tool head may be formed of a soft metallic material.

In a second embodiment the invention is a bucket spreading tool for separating covers of adjacent turbine buckets having: an arm for extending a head of the tool between adjacent turbine wheels and for positioning the head between the adjacent buckets of a wheel; the head including an attachment to an end of the arm and a forward portion having a front side surface shaped to engage a first bucket of said adjacent buckets, and a rear side surface shaped to engage a second bucket of said adjacent buckets, wherein the front side surface is concave to mate with a convex airfoil surface of the first bucket, and the rear side surface of the head is convex to pivot against a concave airfoil surface of the second bucket.

DETAILED DESCRIPTION OF THE INVENTION

Figure 1:
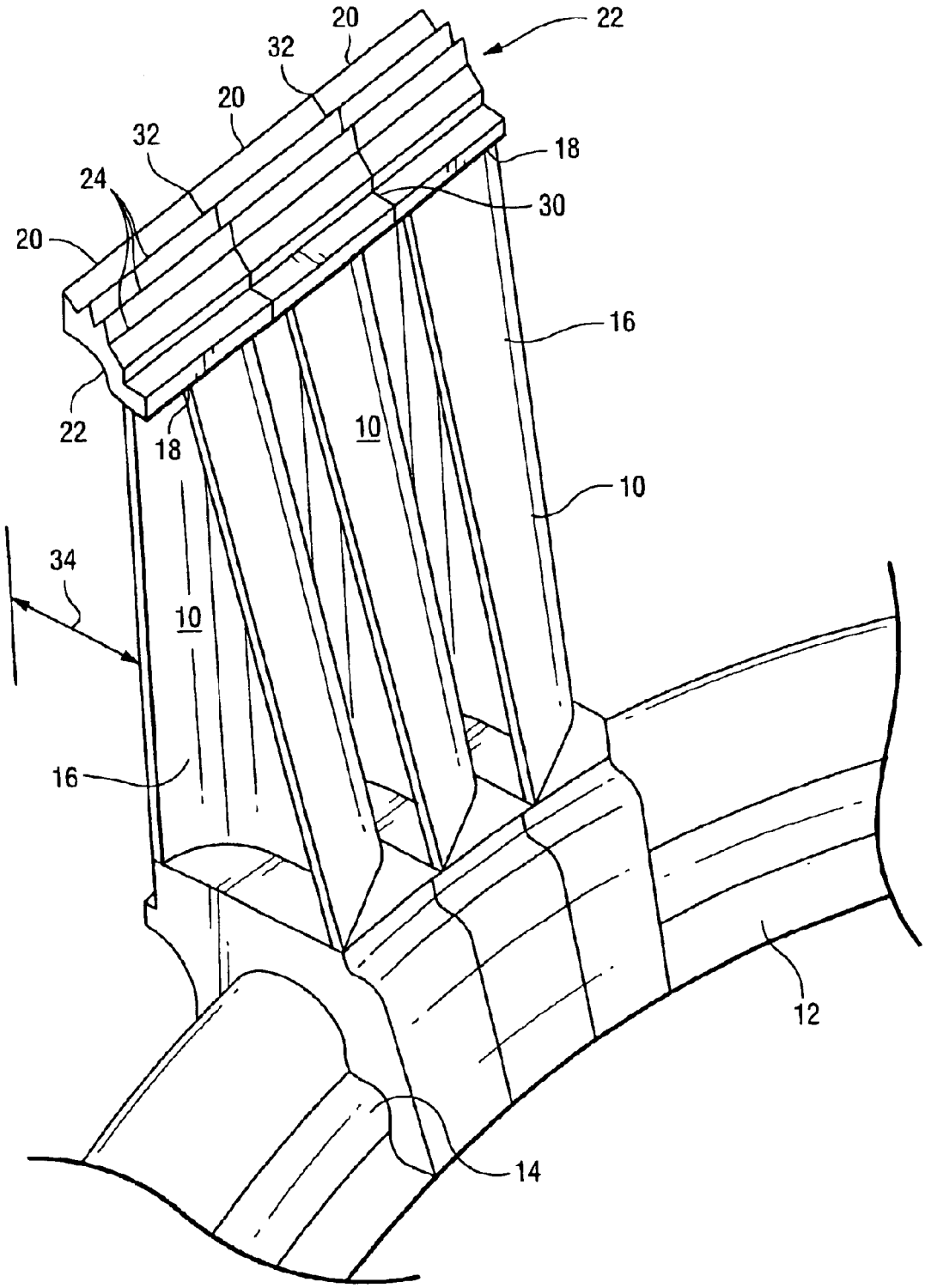
Fig. 1 (PRIOR ART)
FIG. 1 is a perspective view of a portion of a turbine wheel having buckets.

With reference to FIG. 1, a plurality of turbine buckets 10 are secured to a turbine rotor wheel 12. The wheel is mounted on a turbine shaft with a series of other wheels. Each bucket may include a dovetail connector 14 formed in a lower portion of bucket 10. This connector interlocks with a dovetail shaped slot formed on the rim of rotor wheel 12. Buckets 10, only three of which are shown here, extend a full 360° about the rotor wheel 12.

Each bucket has a blades 16 that extends radially upwardly from the dovetail 14 to a tip 18 of the blade. Covers 20 are formed on the blade tips. The covers are preferably of unitary, or one-piece, construction with the remainder of bucket 10. The covers 20 interconnect with adjacent covers to couple the row of buckets together about the rotor wheel 12. Each cover 20 of a bucket has a pair of sides 22. The sides of covers interlock with the sides of covers of adjacent blades. The covers, especially ICVs, may have a steep slope, as is shown in FIG. 1. This slope renders machining of the covers when mounted on a wheel difficult.

After installation on the wheel 12, the covers (ICVs) 20 are machined on their upper surface to include sealing teeth 24 that will line up in sealing engagement with similar teeth on spill strips of the turbine casing. During the machining of the covers 22, shims 26 are inserted between the sides of adjacent covers. The shims reduce the formation of burs on the covers, especially burs that extending into the gap 32 between the sides of covers. The shims 26 are removed after the machining of the covers is completed.

Figure 5:
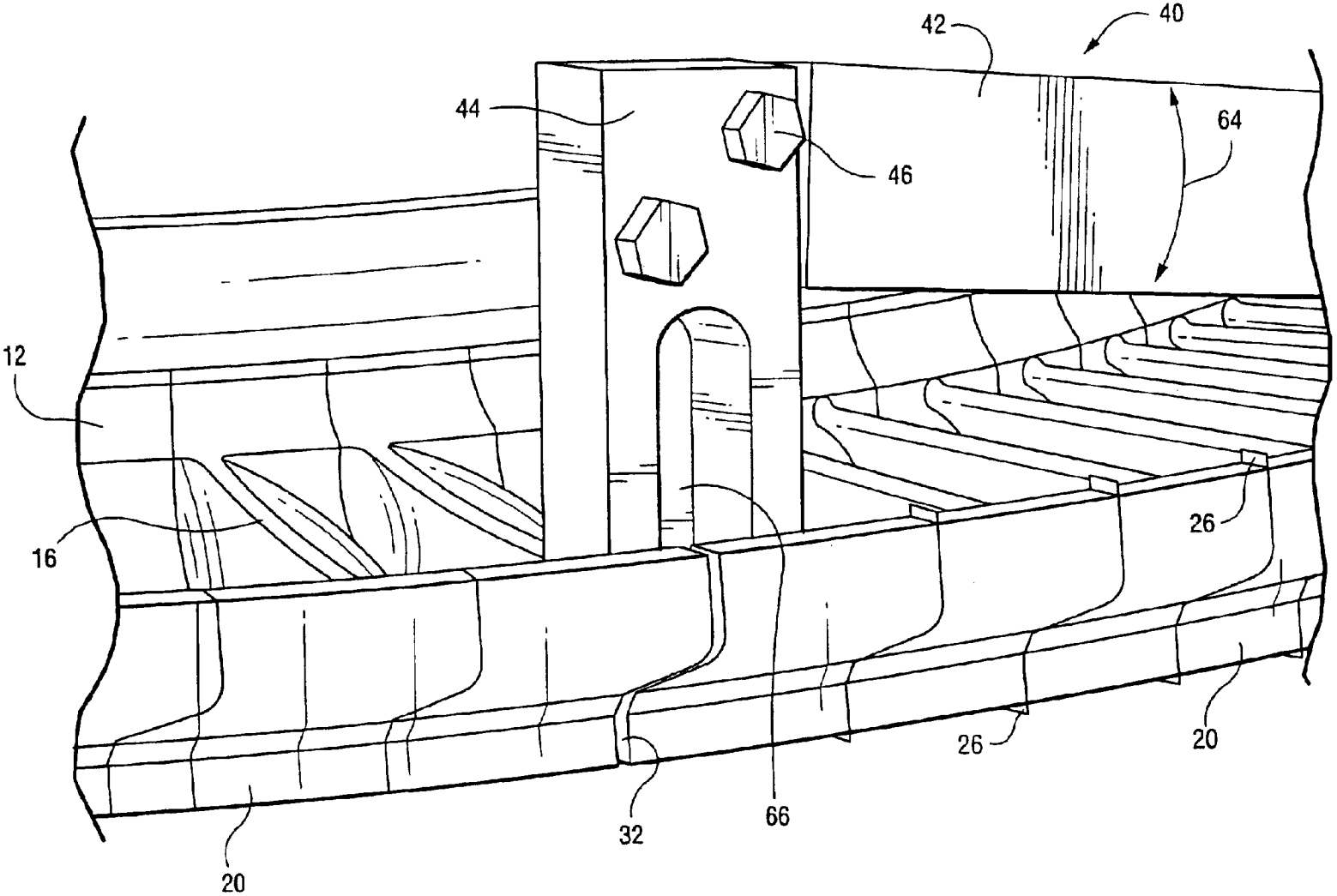

Burs may be formed while machining the teeth 24 on the covers. In some instances, the burs are small and produce a negligible frequency shift in the resonance modes of the buckets. In other instances, the burs are sufficiently large that they bridge the gap 32 and produce substantial resonance modes shifts and need to be removed. The burs are substantially prevented by inserting shims 26 (see FIG. 5) between the covers. The bucket covers need to be separated slightly to allow the shims to be inserted.

Figure 2:
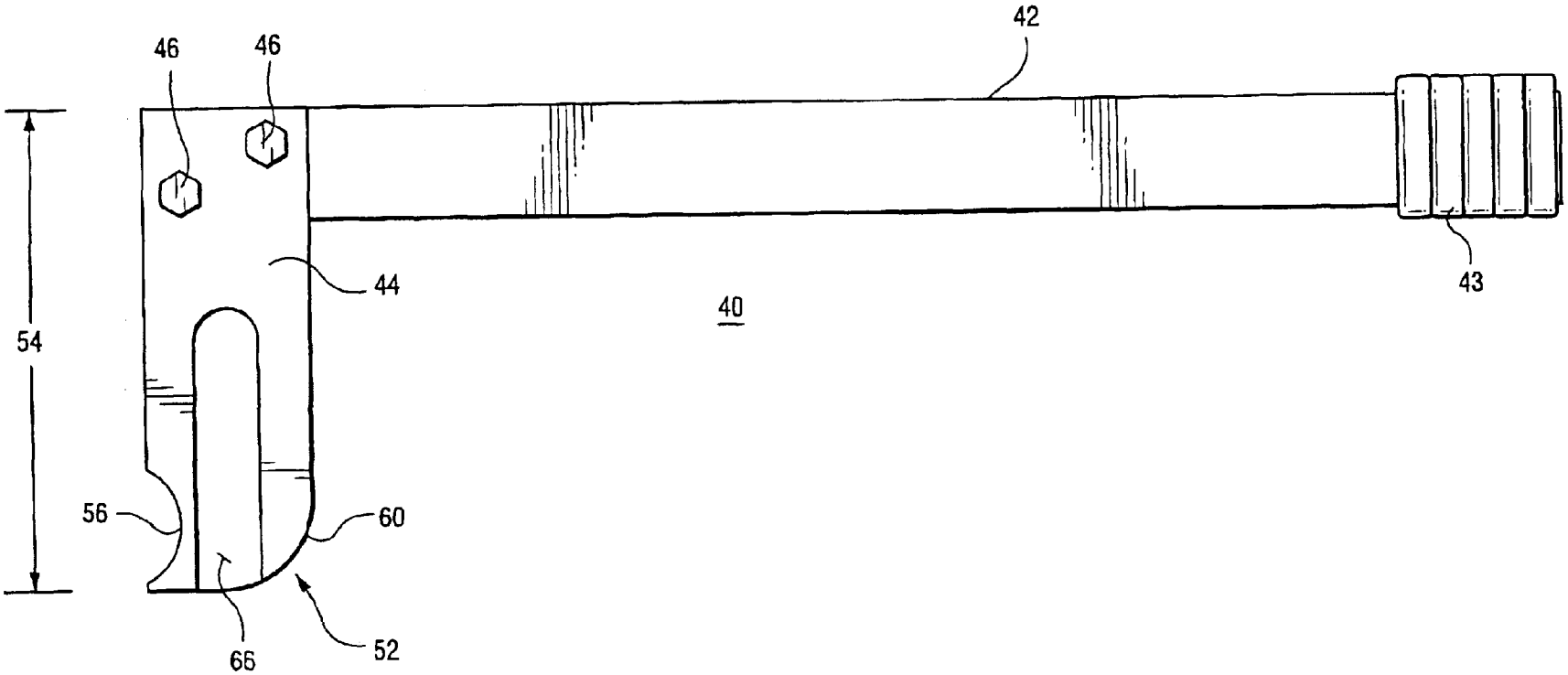
FIG. 2 is a plan view of a bucket spreading tool.

FIG. 2 shows a plan view of a bucket spreading tool 40 which includes an extended slender arm 42, and a head 44. The bucket spreading tool separates the buckets to allow for the insertion and later removal of the shims 26. The head 44 of the tool is inserted between individual turbine buckets and is pivoted to spread apart the buckets and their covers. With the adjacent bucket covers separated, the shims 26 may be inserted. The buckets are spread apart and can be machined while the turbine buckets are assembled on the wheel and the wheels are mounted on the turbine shafts. In addition, the buckets are spread after the turbine casing has been removed to expose the individual rows of turbine buckets, and the turbine nozzles are removed from between each row of turbine buckets.

After removal of the turbine casing and nozzles, there is a gap 34 (see FIG. 1) between the adjacent rows of turbine buckets is typically 5 inches (15 cm) or larger in large steam turbines. Into this gap 34 is inserted the bucket spreading tool 40. The bucket spreading tool is inserted tangentially to the array of buckets so that the tool head 44 can be extended between adjacent wheels and inserted perpendicularly between two selected adjacent buckets on the same wheel. The slender arm 42 of the spreading tool 40 is sufficiently long to allow a technician to reach the tool head 44 between any of the adjacent buckets in any of the rows of buckets in a turbine. The arm has a handle 43 at an end opposite to the head 44. A technician grasps the handle 43 to operate the tool.

Figure 3:
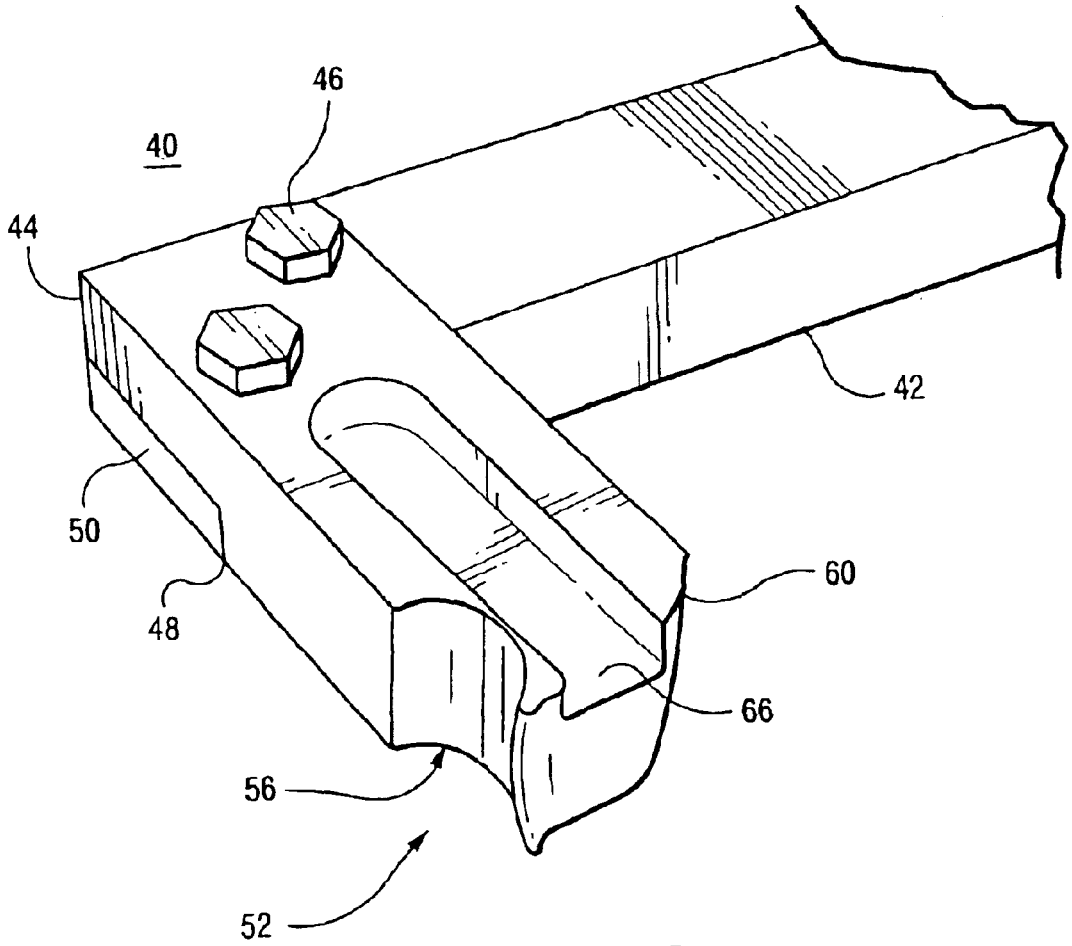
FIG. 3 is an enlarged perspective view of a head of the bucket spreading tool.

The tool head 44 is secured to the arm 44 by bolts 46. A notch 48 in the head may fit with a opposite notch 50 on the arm, as shown in FIG. 3. The bolts 46 and notch connection between the head and arm ensure that the head is securely attached to the arm. The arm 42 may be used to apply a slight torque to the head 44 to spread apart adjacent buckets.

The bolt and notch connection between the tool head 44 and arm 42 allows for relatively easy changing of heads 44 on the arm. Each row of turbine buckets may have a different blade profile. The side surfaces of the front portion 52 of the head 44 are tailored to fit the surfaces of adjacent blades of a particular row of blades. Accordingly, there may be a different heads 44 for each row of blades. By allowing for easy substitution of heads, the arm 42 may be attached to the proper vane head 44 for the particular row of turbine blades desired to be separated and machined.

The height 54 of the tool head 44 is sufficiently short to allow the head to easily fit between adjacent turbine wheels. For example, the height 54 of the head may be three inches (8 cm) or less.

Figure 4:
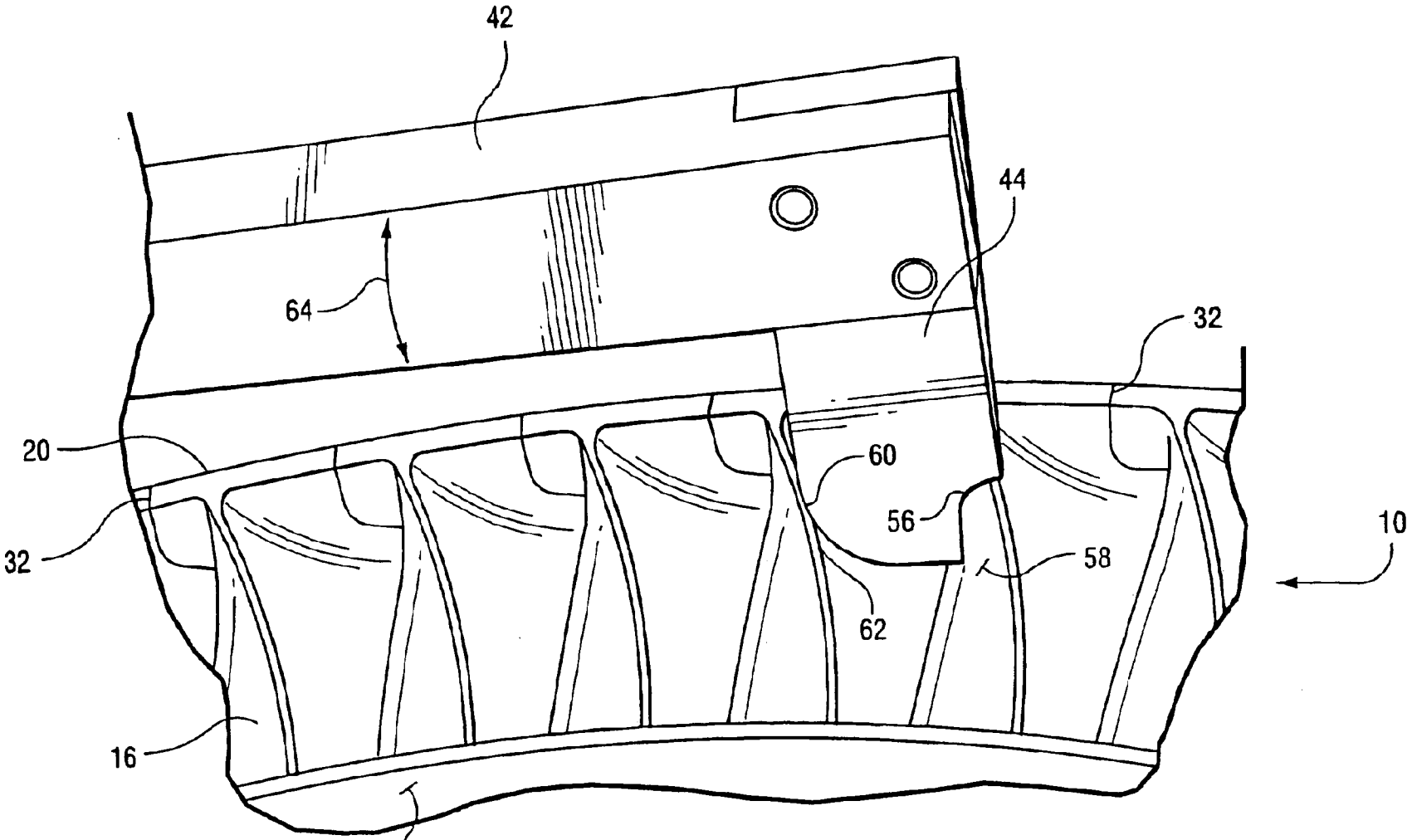
FIGS. 4 and 5 are enlarged perspective views of the back and front, respectively, the spreading tool between adjacent turbine buckets.

The front portion 52 of the head has sides which are shaped to seat on the surfaces of adjacent blades. A forward side surface 56 of the head is cupped to seat on the front surface 58 (see FIG. 4) of a blade. A rear surface 60 of the front portion of the head 52 is rounded to pivot against a back surface 62 of an adjacent blade. The rear surface may have a volute shape so that as the head pivots the width of the head increases to force the buckets apart. As the forward side 56 of the head 44 presses against one blade 58 and the rear side 60 presses against the adjacent blade 62, the pivoting of the head separates the adjacent blades and creates a separation of the gap 32 (see FIG. 5) between the covers of the two blades.

The head 44 is pivoted by the technician who pivots the arm 42 along an arc 64. Once the bucket has been separated and the gap 32 has been widened, a shim 26 remaining in the gap may be removed. To facilitate insertion and removal of shims 26, a slot 66 on the head of the spreading tool allows easy access to the gap and for removal of the shims. Once the shim has been inserted or removed, the technician pivots the arm and head to allow the adjacent buckets to come together. As the tool head 44 unseats from the blades, the head can be removed from between the blades and the head and arm pulled out from between the turbine wheels.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A bucket spreading tool for separating covers of adjacent turbine buckets, said tool comprising:

an arm for extending a head of the tool between adjacent turbine wheels and for positioning the head between the adjacent buckets of a wheel, and the head including an attachment to an end of the arm and a forward portion having a front side surface shaped to mate with a first bucket of said adjacent buckets, and a rear side surface shaped to mate with a second bucket of said adjacent buckets.

2. A bucket spreading tool as in claim 1 wherein the front surface of the head is cupped to abut a convex surface of the first bucket.

3. A bucket spreading tool as in claim 1 wherein the rear surface of the head is rounded to pivot against the second bucket.

4. A bucket spreading tool as in claim 1 wherein the head includes a slot between the front and rear side surfaces, wherein said slot is alignable with a gap between the covers of the adjacent turbine buckets.

5. A bucket spreading tool as in claim 1 wherein the head is separable from the arm.

6. A bucket spreading tool as in claim 1 wherein a height of the head is no greater than three inches.

7. A bucket spreading tool as in claim 1 wherein a height of the head is less than a distance between the adjacent turbine wheels.

8. A bucket spreading tool as in claim 1 wherein in the head is formed of a soft metallic material.

9. A bucket spreading tool for separating covers of adjacent turbine buckets, said tool comprising:

an arm for extending a tool head of the tool between adjacent turbine wheels and for positioning the head between the adjacent buckets of a wheel;

the tool head including an attachment to an end of the arm and a forward portion having a forward side surface shaped to engage a first bucket of said adjacent buckets, and a rear side surface shaped to engage a second bucket of said adjacent buckets, wherein the front side surface is concave to mate with a convex airfoil surface of the first bucket, and the rear side surface of the head is convex to pivot against a concave airfoil surface of the second bucket.

10. A bucket spreading tool as in claim 9 wherein the head includes a slot between the front and rear side surfaces, wherein said slot is alignable with gap between the covers of the adjacent turbine buckets.

11. A bucket spreading tool as in claim 9 wherein the head is separable from the arm.

12. A bucket spreading tool as in claim 9 wherein a height of the head is no greater than three inches.

13. A bucket spreading tool as in claim 9 wherein a height of the head is less than a distance between the adjacent turbine wheels.

14. A bucket spreading tool as in claim 9 wherein in the head is formed of a soft metallic material.

* * * * *